US010603924B2

(12) United States Patent
Sender Beleta et al.

(10) Patent No.: US 10,603,924 B2
(45) Date of Patent: Mar. 31, 2020

(54) PRINT QUALITY EVALUATION

(71) Applicants: Hewlett-Packard Development Company, L.P., Houston, TX (US); Jordi Sender Beleta, Barcelona (ES); Maria Isabel Borrell Bayona, Barcelona (ES)

(72) Inventors: Jordi Sender Beleta, Barcelona (ES); Maria Isabel Borrell Bayona, Barcelona (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/569,940

(22) PCT Filed: Jun. 30, 2015

(86) PCT No.: PCT/EP2015/064903
§ 371 (c)(1),
(2) Date: Oct. 27, 2017

(87) PCT Pub. No.: WO2017/001001
PCT Pub. Date: Jan. 5, 2017

(65) Prior Publication Data
US 2018/0154654 A1 Jun. 7, 2018

(51) Int. Cl.
*B41J 2/21* (2006.01)
*B41J 2/165* (2006.01)
(Continued)

(52) U.S. Cl.
CPC ..... *B41J 2/2146* (2013.01); *B41J 2/155* (2013.01); *B41J 2/16579* (2013.01);
(Continued)

(58) Field of Classification Search
CPC ..... B41J 2/2135; B41J 29/393; B41J 2/2139; B41J 2/2146; G06K 15/02
See application file for complete search history.

(56) References Cited

U.S. PATENT DOCUMENTS 6,968,076 B1 11/2005 Ouyang et al.
8,509,630 B2 8/2013 Henderson et al.
(Continued)

FOREIGN PATENT DOCUMENTS

EP 2422984 2/2012
EP 2465687 6/2012

OTHER PUBLICATIONS

Shankar, et al. "On-line defect detection in web offset printing." Control and Automation, 2003. ICCA'03. Proceedings. 4th International Conference on. IEEEE, 2003, 5 pages.

*Primary Examiner* — Alessandro V Amari
*Assistant Examiner* — Kendrick X Liu
(74) *Attorney, Agent, or Firm* — HP Inc. Patent Department

(57) ABSTRACT

Certain examples described herein relate to evaluating print quality. In these examples, a check image is printed at a first print quality in accordance with test image data for at least one test image, and a reference image is printed at a second print quality with reference image data corresponding to the one or more test images modified to simulate one or more print defects. A comparison of the printed reference image and the printed check image allows evaluation of a quality level for the printed check image.

15 Claims, 8 Drawing Sheets

(51) Int. Cl.
*B41J 2/155* (2006.01)
*B41J 29/393* (2006.01)

(52) U.S. Cl.
CPC ..... *B41J 2/16585* (2013.01); *B41J 2/2135* (2013.01); *B41J 2/2139* (2013.01); *B41J 2/2142* (2013.01); *B41J 29/393* (2013.01)

(56) References Cited

U.S. PATENT DOCUMENTS

| | | | | |
|---|---|---|---|---|
| 2003/0193684 | A1 | 10/2003 | Kendall et al. | |
| 2008/0068639 | A1* | 3/2008 | Satoh ..... | G06K 15/002 358/1.14 |
| 2013/0021398 | A1 | 1/2013 | Mizes et al. | |
| 2013/0182972 | A1 | 7/2013 | Jing et al. | |
| 2014/0348393 | A1 | 11/2014 | Kogan | |
| 2015/0062233 | A1* | 3/2015 | Ueshima ..... | B41J 29/393 347/19 |

* cited by examiner

PRINT QUALITY EVALUATION

BACKGROUND

Standard printers generally comprise a printhead mounted to a carriage that moves across a print area in a scanning direction at high speed, while a print medium is conveyed through the print area along a conveying direction transverse to the scanning direction of the printhead. The rapid movement of the printhead may introduce some print defects, but also allow various techniques for mitigating the impact of print defects caused by misplaced or irregular print dots. In particular, different print modes can be employed involving different numbers of passes of the printhead over the print medium, with the highest quality print modes being close to defect free.

In contrast, a page wide array printer has a nozzle array that extends across the width of a page. In this way, in at least one example a moving carriage is not needed, and therefore a page wide array printer may not exhibit the types of print defects associated with the movement of a printhead. A page wide array printer also, however, may lack the flexibility of a printer with a scanning head when addressing print defects caused by missing, misplaced or irregular print dots.

BRIEF DESCRIPTION OF THE DRAWINGS

Various features of the present disclosure will be apparent from the detailed description which follows, taken in conjunction with the accompanying drawings, which together illustrate, by way of example, features of the present disclosure, and wherein.

DETAILED DESCRIPTION

Figure 1:
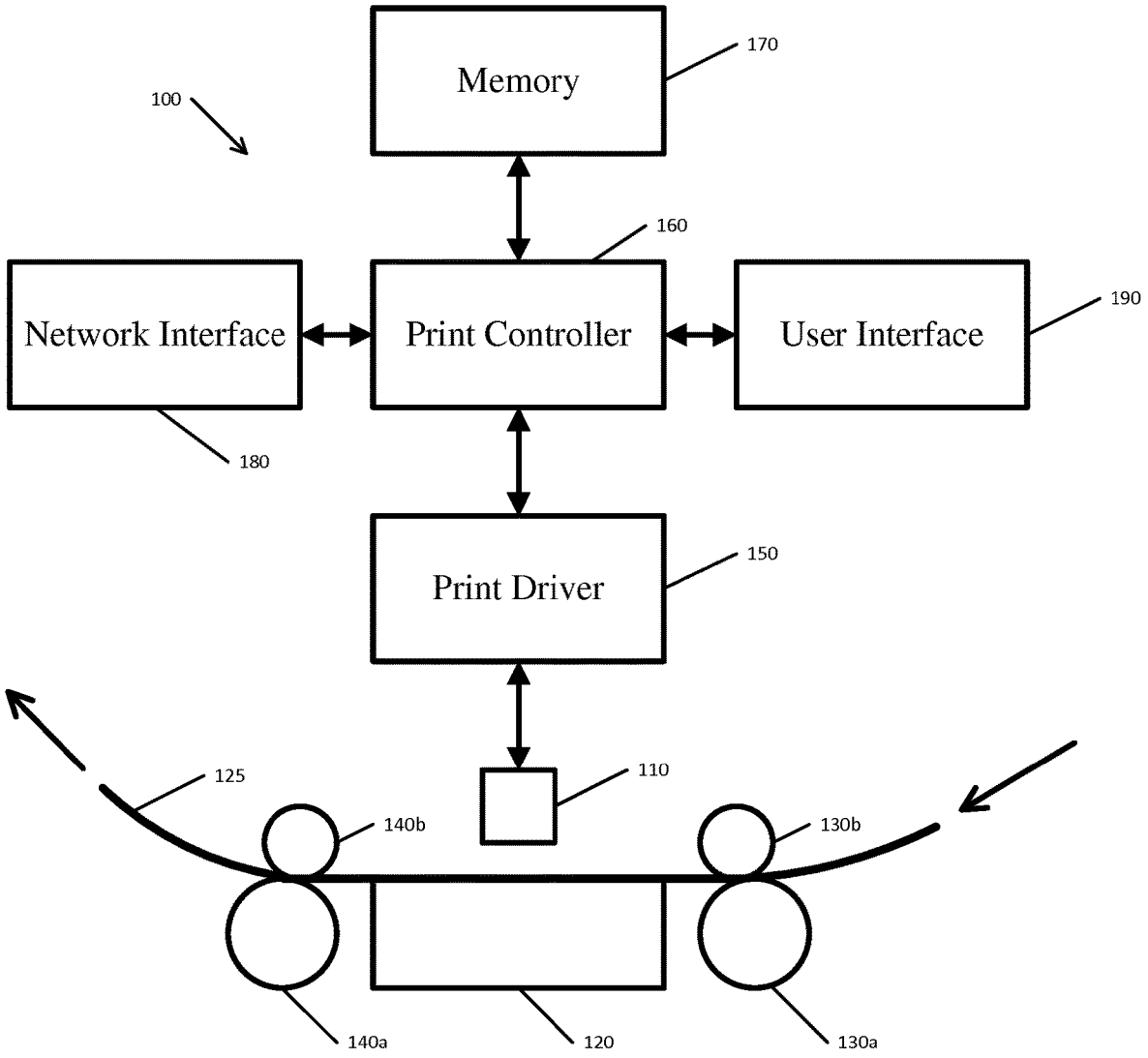
FIG. 1 is a schematic diagram showing the main components of a page wide array printer according to an example.

FIG. 1 shows the main components of a page wide array printer 100. As shown, the page wide array printer 100 has a print bar 110 facing a platen 120. The print bar 110 has an array of nozzles (not shown in FIG. 1) for ejecting ink onto a print medium 125, such as paper or an acetate sheet, in a print area between the print bar 110 and the platen 120. A conveyor, in this example including feed rollers 130*a*, 130*b* and exit rollers 140*a*, 140*b*, feeds the print medium 125 through the print area between the print bar 110 and the platen 120 in a conveying direction (indicated by the arrows in FIG. 1).

The print bar 110 extends across the print area over the full width of the print medium 125 in a direction transverse to the conveying direction. As the print medium 125 passes through the print area adjacent the print bar 110, ink is ejected from the print bar 110 onto the print medium 125 in accordance with drive signals supplied by a print driver 150.

A print controller 160 is connected to the print driver 150, memory 170, a network interface 180 and a user interface 190. The memory 170 stores both control routines and image data. The network interface 180 enables the page wide array printer 100 to receive data from a remote network device (not shown) via a telecommunications network. The user interface 190 includes at least one input device, such as a touchscreen or a keyboard, to enable a user to enter data directly into the page wide array printer 100. In addition, the user interface 190 includes at least one output device, such as a screen or indicator lights, to enable the page wide array printer 100 to convey information directly to a user.

Print quality relates to the accuracy with which a printer reproduces image data in a printed image. Various print techniques are known to improve print quality, but come at a cost of either slower printing or the use of more ink. Accordingly, a printer is often operated at a print quality below the maximum available print quality for that printer.

Some print defects are to be expected from any printer. Although the number and severity of the print defects may often be reduced by servicing and/or repair of the printer, some defects that are effectively inherent to the printer will remain after such servicing and/or repair. A challenge therefore arises in evaluating whether the print quality is likely to be improved by servicing and/or repair prior to incurring the cost of servicing and/or repair. In this example, the memory 170 stores a routine for a diagnostic print mode, which can be initiated by the user via the user interface 190, to allow a user to make an assessment of whether print quality is likely to be improved by servicing and/or repair.

Figure 2:
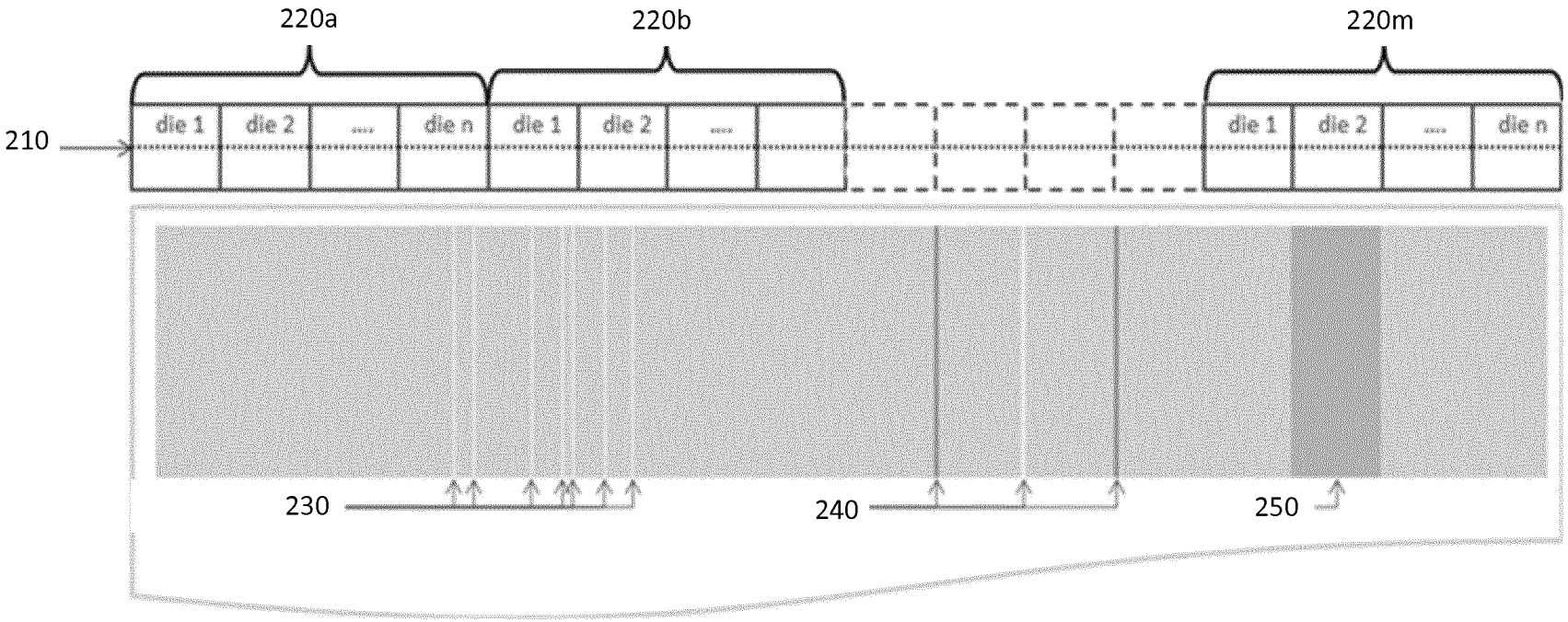
FIG. 2 is a schematic diagram of the main components of a print bar forming part of the page wide array printer illustrated in FIG. 1, and also shows print defects occurring in the output of a page wide array printer according to an example.

FIG. 2 schematically shows in more detail the components of the print bar 110 illustrated in FIG. 1. As shown, the print bar 110 has a nozzle array 210 that extends in a rectilinear direction over the entire width of the printing area. Given practical difficulties associated with manufacturing a print bar with all the nozzles of the nozzle array disposed in a single substrate, the print bar 110 of this example comprises a plurality of print heads 220*a*-220*m* arranged end to end, with each print head 220 including a plurality of semiconductor dies arranged end to end. In this way, the array of nozzles is disposed over a plurality of semiconductor dies.

In contrast to printers with a scanning printhead, the print bar 110 of the page wide array printer may be fixed in position with respect to the platen. As such, the entirety of an image may be printed in a single pass of the print medium in the conveying direction past the array of nozzles 210 of the print bar 110. However, despite all calibrations, checks and maintenance routines, single pass printing may show some level of print defects depending on the image content. At least some of the print defects occurring in a page wide array printer can be classified in three main groups:

Missing Dots: an inoperative nozzle, i.e. a nozzle that does not eject ink in response to a drive signal, can result in a vertical line in a printed document. Such print defects are indicated by the reference numeral 230 in FIG. 2, and can occur at any point in a printhead.

Misplaced Dots: dot position errors, caused by misdirection of ink ejected from a nozzle, such as those indicated by the reference numeral 240 in FIG. 2, can happen at discontinuities in the print bar, either die to die or printhead to printhead joins. To ensure nozzle array continuity, a real configuration of a print bar 110 may involve staggering of the dies or printheads. These print defects can manifest as line banding at the die stitching positions.

Drop Weight Variability: drop weight variability may occur within a die, between dies or between printheads. As indicated by the reference numeral 250 in FIG. 2, these print defect can manifest as color bands between dies.

It can be difficult for a user to assess whether a page wide array printer is performing at a print quality that is within specification, for which servicing or repair may serve no useful purpose, or outside of specification, for which servicing or repair may be useful. If this assessment is incorrectly performed, the page wide array printer may be subjected to repair or servicing that is does not enhance print quality. Also, an incorrect assessment may result in user dissatisfaction.

For a standard printer with a scanning printhead, image quality may be assessed by printing color bands at the highest quality print mode, for which printing can be assumed to be error free. If any print defects are visible in these color bands, then the printer may have some form of operational error and therefore may need to be serviced or repaired. Such an approach would be difficult for a page wide array printer as defect free printing is generally not achievable.

A page wide array printer, however, may have the advantage that there is no moving carriage on which the printhead is mounted and the print medium is conveyed at a constant speed e.g., in the range 1-20 inches (about 2.5 to 50) centimeters per second) past the print bar 110. Thus, the printed images output by a single die may have repeatable print quality. By utilizing a print technique that avoids simultaneous printing by adjacent dies so that there is minimal (or even no) induced airflows between dies, a high level of repeatability can be achieved with a minimal number of print defects. By way of example, this repeatable print quality within a single die is used in a print diagnostic mode for the evaluation of print quality as follows.

Figure 3:
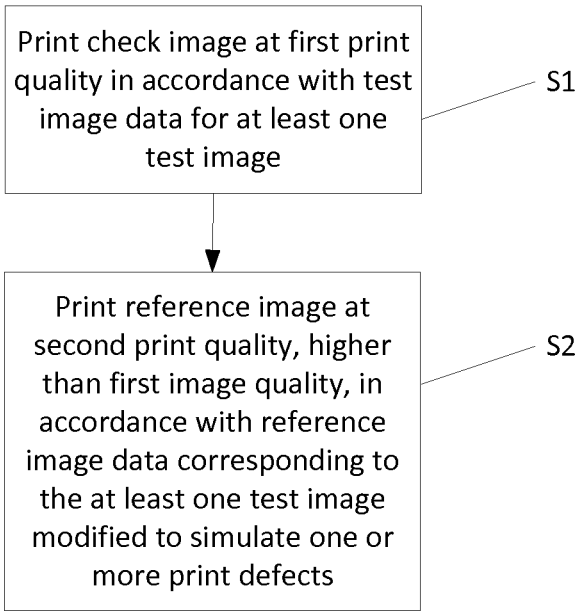
FIG. 3 is a flow diagram showing printing operations performed in a method for evaluating print quality according to an example.
Figure 4:
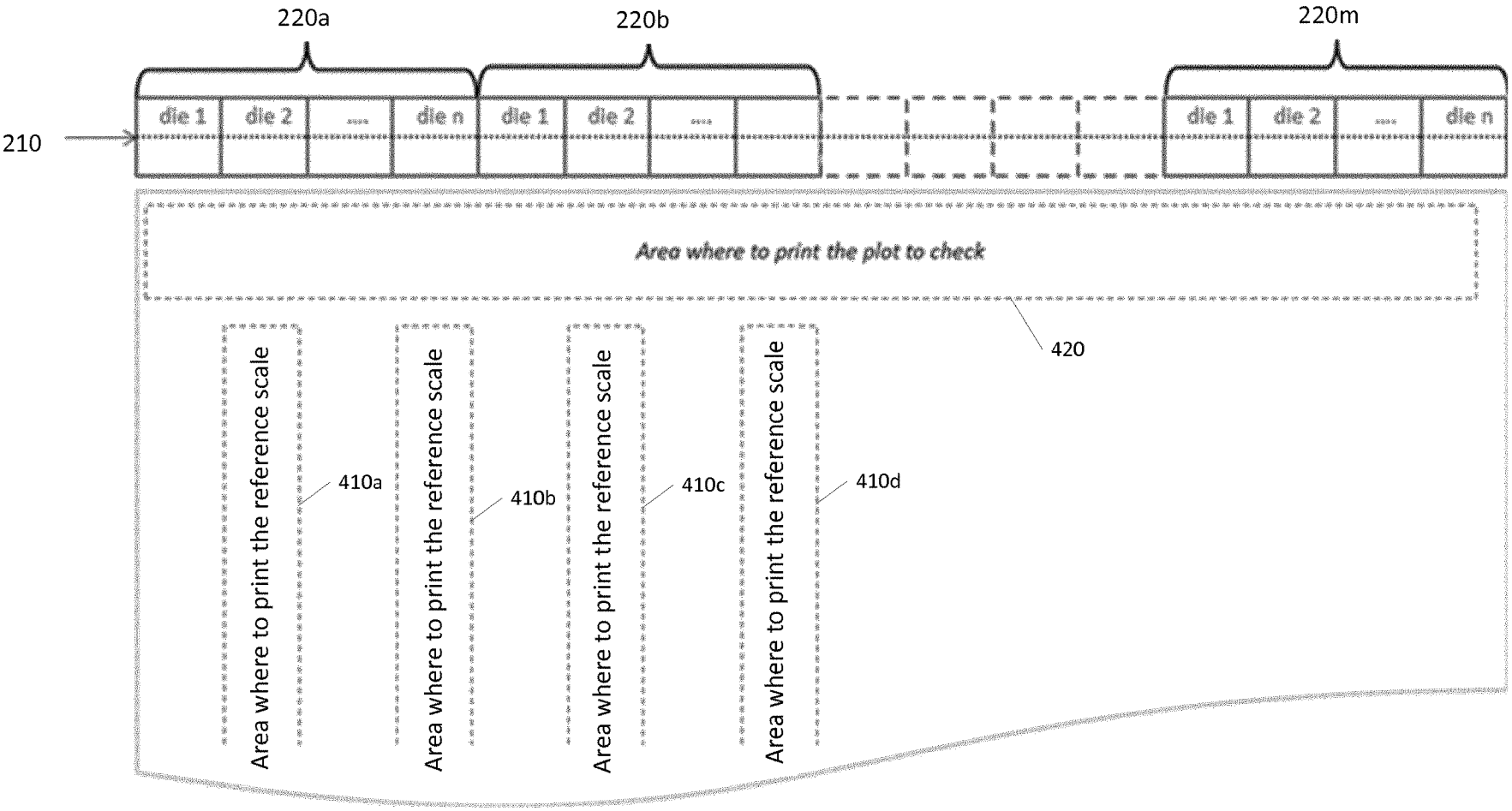
FIG. 4 is a schematic diagram showing the main components of the print bar and the output of printing of a check image and multiple reference images according to an example.

As shown in FIGS. 3 and 4, the page wide array printer prints, at 51, check image data to generate a check image in the form of a single band 420 in a first direction aligned with the array of nozzles. The check image data correspond to a defect free band (i.e. a band of constant coverage, brightness and color) and are printed at a first print quality corresponding to a print quality setting for the page wide array printer 100 used in normal operation. The check image is printed using ink ejection by adjacent nozzles on different dies.

The page wide array printer also prints, at S2, reference image data corresponding to a series of bands 410*a*-410*d*, collectively color bands 410, extending in a second direction transverse to the array of nozzles, with each band 410 being printed using the nozzles of a single die. The color bands 410 are arranged to avoid adjacent nozzles on different dies printing at the same time, to minimize induced airflows between dies. The image data for these bands 410 correspond to a defect free band deliberately modified to include within the image data artefacts corresponding to print quality defects. In this example, the image data for each band 410 in the reference image include simulated print defects for a respective different print quality, so that each band 410 forms a reference image for a corresponding print quality. The reference image data are printed using the highest quality printing settings available for the page wide array printer, generally corresponding to a slow conveying speed of the print medium.

The user may then be able to compare the color band 420 of the check image with the color bands 410 of the reference images to evaluate the print quality. In particular, the user may evaluate the color band 420 of the check image and the color bands 410 of the reference images to identify the reference image whose apparent print quality (i.e. assuming the artefacts in the printed reference image corresponding to the simulated print defects in the image data to be real print defects) most closely resembles that of the check image. In this example, this evaluation may be carried out by eye by the user. In other words, through visual comparison of the color band 420 of the check image and the color bands 410 of the reference images, the user makes a qualitative assessment as to which of the color bands 410 of the reference images appears to have the closest print quality to that of the color band 420 of the check image. This qualitative assessment may take account of both the number of print defects and the noticeability of each print defect.

In one example, if the reference image which appears closest in print quality to the check image corresponds to a print quality that is within specified performance for the printer, no further action is taken. If, however, that reference image corresponds to a print quality that is outside of specified performance for the printer, repair or servicing may usefully take place.

Figure 5A:
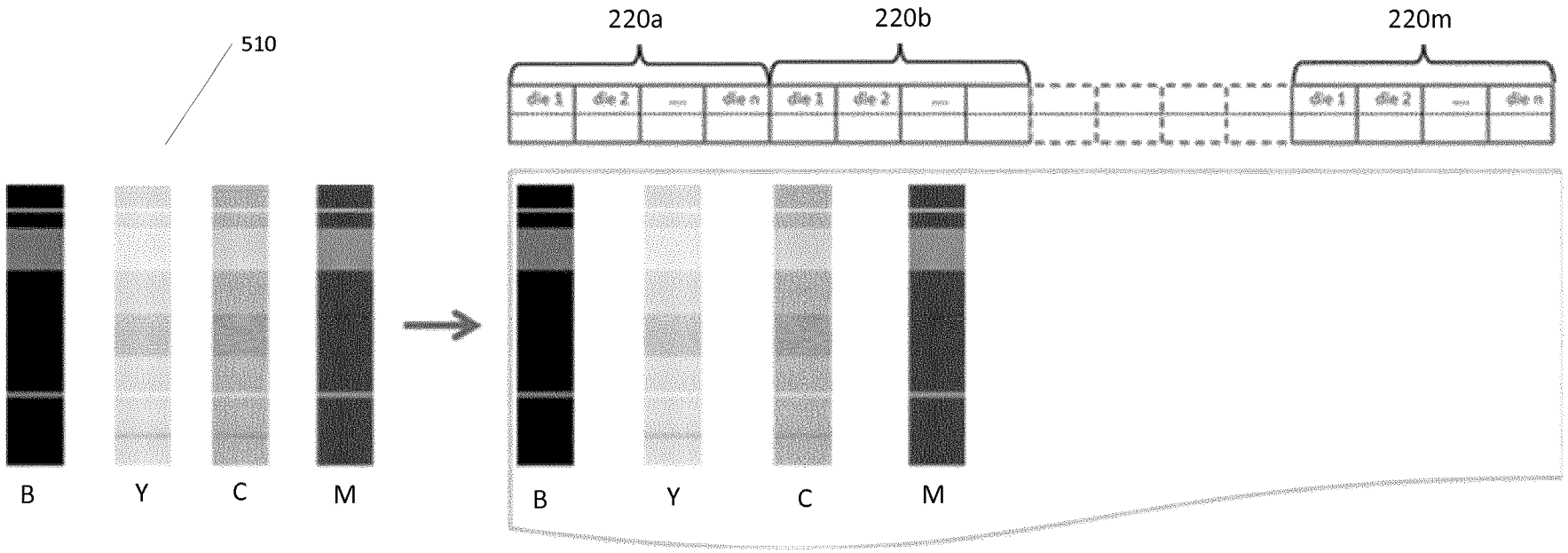
FIG. 5A is a schematic diagram showing the main components of the print bar and the output of printing a reference image having multiple color bands according to an example.
Figure 5B:
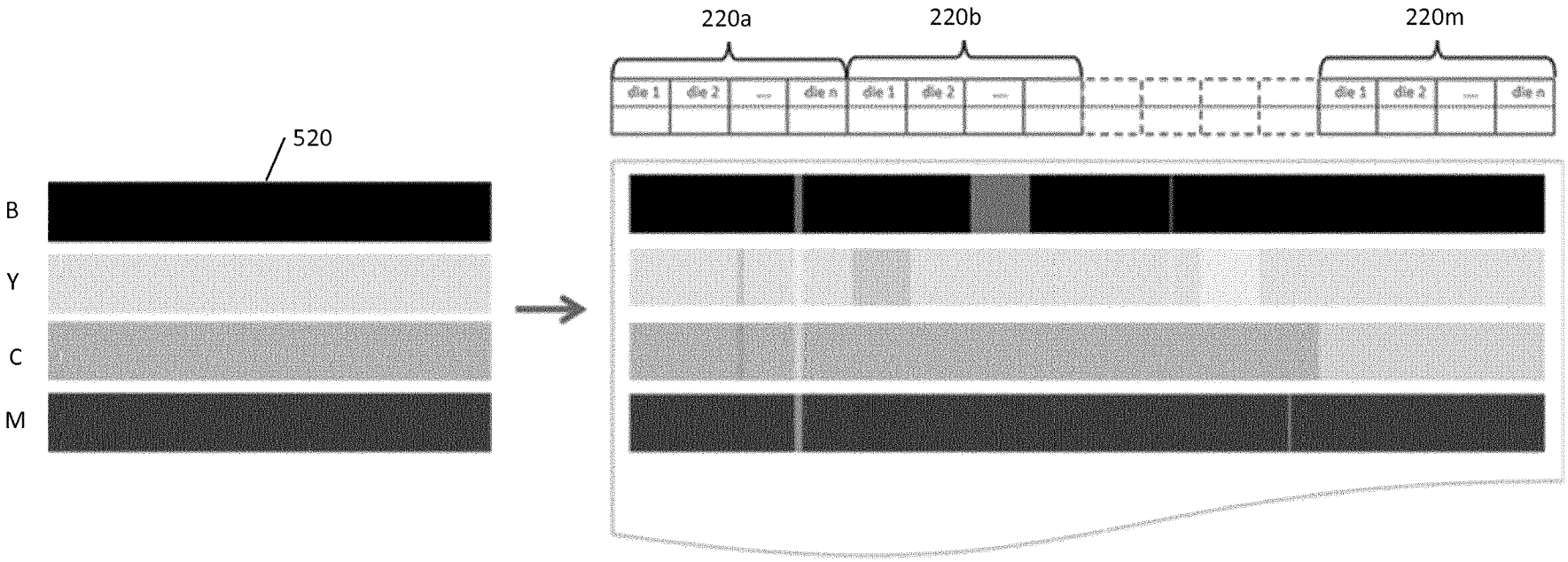
FIG. 5B is a schematic diagram showing the main components of the print bar and a check image having multiple color bands according to an example.
Figure 5C:
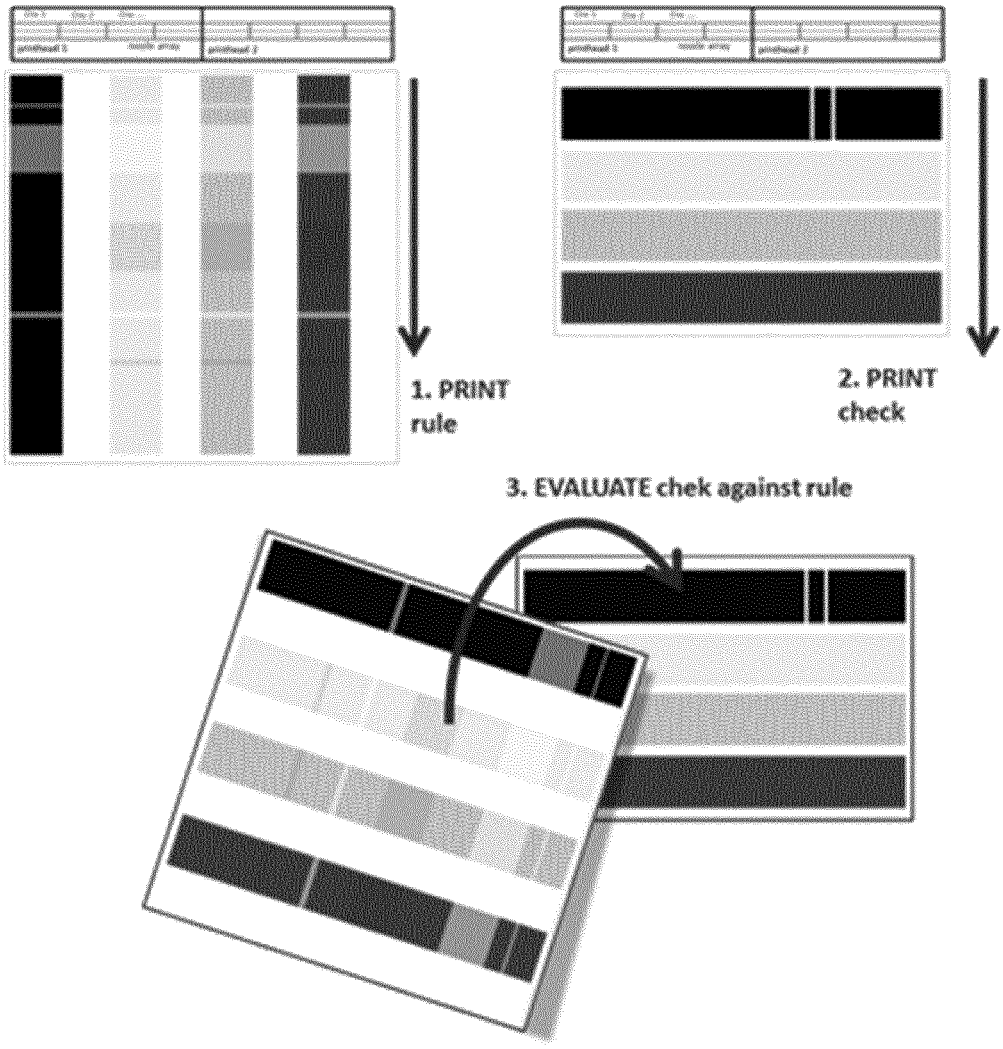
FIG. 5C shows the comparison of printed reference image and printed check image according to an example.

FIGS. 5A to 5C show another example in which the print bar has nozzles for ejecting different colored inks. As in the previous example, reference image data 510 for a reference image are printed. In this example, the reference image data 510 correspond to a series of color bands modified to simulate print defects corresponding to a threshold print quality. In particular, the series of color bands comprise a black color band (labelled B in FIGS. 5A and 5B), a yellow color band (labelled Y in FIGS. 5A and 5B), a cyan color band (labelled C in FIGS. 5A and 5B) and a magenta color band (labelled M in FIGS. 5A and 5B). Each color band is printed by a respective different die, with no printing being performed by adjacent dies. Check image data 520 are then printed corresponding to the same series of color bands with no simulated print defects and printed in 'landscape' so that each color band is printed using all the nozzles in the array of nozzles of the print bar 110.

A user can then rotate the printed check image and compare the rotated check image to the reference image. In this example, this comparison involves a qualitative evaluation by eye between the rotated check image and the reference image. If the print quality of the printed check image appears to the user to be worse than the apparent print quality of the printed reference image (assuming the simulated print defects in the printed reference image are real print defects), then repair or servicing may be useful.

In another example, reference color bands can be printed corresponding to a series of print quality levels, so that the printed check image can be compared with printed reference images of different qualities.

The reference image and the check image can be printed in any order.

The print evaluation techniques described above may allow print quality for a page wide array printer to be evaluated without any external tooling or equipment. This evaluation can be useful as user feedback and also for prevention of unnecessary servicing or repair.

Although the print evaluation techniques are well suited for page wide array printers, the print evaluation techniques can be utilized in other printers by printing the reference images using a print mode corresponding to a high print quality such that the printed image is expected to be defect free, and printing the check image at lower quality.

It will be appreciated that the reference image data and the check image data may be stored in image files (for example, bitmaps) in the memory 170 of the printer 100. Alternatively, one or both of the reference image data and the check image data may be generated by a routine stored in the memory 170 of the printer 100.

Figure 6:
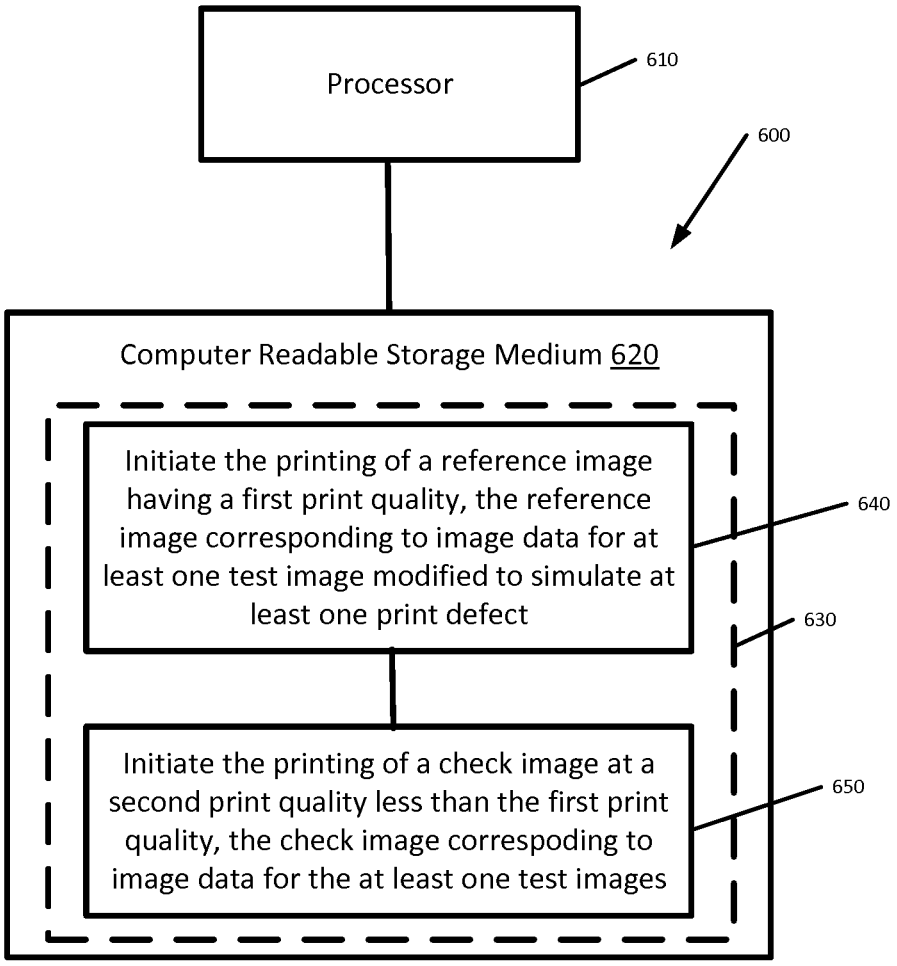
FIG. 6 is a schematic diagram showing a computing device according to an example.

Certain system components and methods described herein may be implemented by way of non-transitory computer program code that is storable on a non-transitory storage medium. FIG. 6 shows an example 600 of a print control system 600 comprising at least one processor 610 arranged to retrieve data from a computer readable storage medium 620. The computer-readable storage medium 620 comprises a set of computer-readable instructions 630 stored thereon. The set of computer readable instructions are arranged to cause the at least one processor to perform a series of actions. Instruction 640 is arranged to initiate the printing of a reference image at a first print quality, the reference image corresponding to image data for at least one test image modified to simulate at least one print defect. Instruction 650 is arranged to initiate the printing of a check image at a second print quality, the check image corresponding to image data for the at least one test images and the first print quality being higher than the second print quality.

The non-transitory storage medium can be any media that can contain, store, or maintain programs and data for use by or in connection with an instruction execution system. Machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of evaluating print quality, the method comprising:

printing a check image at a first print quality, the check image being printed in accordance with test image data for at least one test image; and printing a reference image at a second print quality, the reference image being printed in accordance with reference image data corresponding to the at least one test image modified to simulate one or more print defects, wherein the first print quality is lower than the second print quality, whereby a comparison of the printed reference image and the printed check image allows evaluation of print quality for the printed check image.

2. The method according to claim 1, wherein each of the printing of the reference image and the printing of the check image comprise one-pass printing using an array of nozzles extending across a print area, the array of nozzles comprising a plurality of sets of nozzles with each set of nozzles disposed over a respective different die.

3. The method of claim 2, wherein printing the reference image comprises printing a band modified to simulate print defects indicative of at least one of: an inoperative nozzle, variation of ink ejection amount from a nozzle, and misdirection of ink ejected from a nozzle.

4. The method of claim 3, wherein printing the reference image at the first print quality comprises printing the band using nozzles from a single set of the array of nozzles.

5. The method according to claim 4, wherein printing the reference image at the first print quality comprises printing a plurality of color bands, each color band being printed by ejecting ink from nozzles of a respective different set of the plurality of sets of nozzles.

6. The method according to claim 4, wherein printing of the check image at the second print quality comprises printing a color band using nozzles from a plurality of different dies.

7. The method according to claim 6, wherein the color band of the check image is printed in a first direction aligned with the array of nozzles, and the color band of the test image is printed in a second direction transverse to the array of nozzles.

8. The method of claim 1, comprising printing a plurality of reference images, each reference image being printed in accordance with image data corresponding to the at least one test image modified to simulate at least one print defect corresponding to the respective print quality.

9. A printer apparatus comprising:

an array of nozzles to eject ink onto a print medium, the array of nozzles extending across a print area, the array of nozzles comprising a plurality of sets of nozzles, each set of nozzles disposed over a respective different die;

a conveyer to convey a print medium along a conveying direction through the print area, the conveying direction being transverse to the array of nozzles; and a print controller to control drive signals to the array of nozzles in accordance with image data, wherein the print controller comprises a diagnostic print mode to evaluate print quality, the print controller being arranged, following initiation of the diagnostic print mode, to print a reference image and to print a check image, wherein the reference image is associated with reference image data corresponding to at least one test image modified to simulate at least one print defect, the reference image being arranged to avoid ink ejection by adjacent nozzles on different dies, and wherein the check image is associate with test image data for the at least one test image arranged for ink ejection by adjacent nozzles on different dies.

10. The printer apparatus according to claim 9, wherein the test image comprises at least one color band.

11. The printer apparatus according to claim 10, wherein the reference image comprises the at least one color band modified to simulate print defects indicative of at least one of: an inoperative nozzle, variation of ink ejection amount from a nozzle, and misdirection of ink ejected from a nozzle.

12. The printer apparatus according to claim 11, wherein the print controller is arranged to print the reference image with each of said at least one modified color band extending in a direction parallel to the conveying direction.

13. The printer apparatus according to claim 12, wherein the simulated print defects extend in a direction transverse to the conveying direction.

14. The printer apparatus according to claim 10, wherein the print controller is arranged to print the check image with each of said at least one color band extending in a direction transverse to the conveying direction.

15. A non-transitory computer-readable storage medium comprising a set of computer-readable instructions stored thereon, which, when executed by a processor, cause the processor to:

initiate the printing of a reference image at a first print quality, the reference image corresponding to image data for at least one test image modified to simulate at least one print defect; and initiate the printing of a check image at a second print quality, the check image corresponding to image data for the at least one test images, wherein the first print quality is higher than the second print quality.

* * * * *